US006931890B2

(12) United States Patent
Stingel et al.

(10) Patent No.: US 6,931,890 B2
(45) Date of Patent: Aug. 23, 2005

(54) LATCH NEEDLE

(75) Inventors: Uwe Stingel, Messtetten (DE); Hans-Wolfgang Schmoll, Haigerloch (DE); Uwe Hennig, Burladingen (DE); Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/937,604

(22) Filed: Sep. 10, 2004

(65) Prior Publication Data

US 2005/0050924 A1 Mar. 10, 2005

(30) Foreign Application Priority Data

Sep. 10, 2003 (DE) ..... 103 41 630

(51) Int. Cl.[7] ..... D04B 35/04
(52) U.S. Cl. ..... 66/121
(58) Field of Search ..... 66/116, 121, 122, 66/123, 124

(56) References Cited

U.S. PATENT DOCUMENTS

| | | | | | |
|---|---|---|---|---|---|
| 1,032,613 | A | * | 7/1912 | Korndoerfer | 66/122 |
| 1,163,296 | A | | 12/1915 | Williams | |
| 1,732,469 | A | * | 10/1929 | Hague | 66/117 |
| 2,536,478 | A | * | 1/1951 | Marcel | 66/117 |
| 4,747,277 | A | * | 5/1988 | Majer | 66/122 |
| 4,791,794 | A | | 12/1988 | Schmoll | |
| 5,239,844 | A | | 8/1993 | Sos | |
| 5,488,840 | A | * | 2/1996 | Wiedenhofer | 66/122 |
| 5,956,976 | A | * | 9/1999 | Schaffer et al. | 66/121 |
| 2002/0152774 | A1 | | 10/2002 | Sauter et al. | |
| 2004/0011086 | A1 | | 1/2004 | Wang | |

FOREIGN PATENT DOCUMENTS

| | | |
|---|---|---|
| DE | 37 02 019 C1 | 9/1987 |
| DE | 41 42 003 C1 | 7/1993 |
| GB | 380554 | 7/1931 |
| JP | 61-133586 | 8/1986 |
| JP | 08-060504 | 3/1996 |

* cited by examiner

*Primary Examiner*—Danny Worrell
(74) *Attorney, Agent, or Firm*—Fitch, Even, Tabin & Flannery; Norman N. Kunitz; George H. Spencer

(57) ABSTRACT

A latch needle (1) is provided with a latch (5), which has a clearing profile (19) on its latch shank end (18). The clearing profile (19) serves to keep the sawslot (6) free of dirt. To that end, it has at least one special clearing face (24).

19 Claims, 7 Drawing Sheets

LATCH NEEDLE

CROSS REFERENCE TO RELATED APPLICATION

This application claims the priority of German Patent Application No. 103 41 630.7, filed on Sep. 10, 2003, the subject matter of which, in its entirety, is incorporated herein by reference.

FIELD OF THE INVENTION

The invention relates to a latch needle, in particular for knitting machines.

BACKGROUND OF THE INVENTION

Knitting machines are often equipped with so-called latch needles, which have a slender needle body that on one end forms a shank, and the shank, on its free end, changes over into a hook. In the vicinity of the hook, a sawslot is provided, in which a pivotably supported latch is disposed. This latch can execute a pivoting motion, thereby opening or closing the yarn space of the hook. Such latch needles are known, for instance from Japanese Patent Disclosure JP 61-133586. This latch needle has a sawslot that extends continuously from the needle cheek to the needle back, and the latch is supported freely pivotably in this sawslot without hindrance. In the vicinity of the latch bearing, the latch has a blunt extension with a rounded tip.

From U.S. Pat. No. 1,163,296, a sawslot is also known whose latch can be moved via a slide provided on the needle. To that end, the latch has a recess on one end, and this recess is associated with the tip of the slide, and by means of it the latch can be pressed away from the hook or the needle back as needed.

Because of the slide protruding into the sawslot, the latch is only conditionally freely rotatable. It is possible to operate such needles only with cams that have an additional track for the slide.

From Japanese Patent Disclosure JP 8-60504, a latch needle with a sawslot that is open at the back and with a latch spring that cooperates with the latch is known. On its end toward the spring, the latch has a flattened face and a cam, in order to define two stable positions of the latch.

All the needles mentioned suffer soiling in operation, and as a consequence a mass composed of fiber residues, oil and dust, for instance, can collect in the sawslot. Such accumulations of dirt impair the function of a latch needle if they become excessive.

SUMMARY OF THE INVENTION

It is the object of the invention to create a latch needle which is less vulnerable to soiling.

The above object generally is attained with a latch needle according to the invention that has a latch which on its end supported in the sawslot is embodied or formed as a cleaning profile for the sawslot. This is attained by providing the latch with a special cleaning profile. The cleaning profile serves to move fiber residues or other dirt that has reached the sawslot and push it out of the sawslot during the reciprocating motion of the latch. Thus the mobility of the latch can be preserved even if a relatively large amount of abraded fiber or other dirt occurs and reaches the sawslot.

The cleaning profile is preferably a shoulder or extension embodied on the latch spoon, but the latch, as viewed from the center of the latch hole, is lengthened only insignificantly as a result, if at all. Preferably, the spacing between the end face of the protrusion and the center of the latch hole is no greater, or not significantly greater, than the spacing of the flanks from the center of the latch hole. The size ratio is preferably approximately 0.8 to 1.5, and preferably 1.

Also preferably, the cleaning profile has at least one sharp edge, which extends parallel to the latch hole, transversely across the entire width of the latch. The radius of the rounding of this edge is as slight as possible. Thus dirt present in the sawslot is reliably caught and pushed out of the sawslot. The cleaning profile furthermore has a face that is as flat as possible and is oriented approximately radially relative to the latch hole; this face serves to push fiber residues or other dirt in front of it in the pivoting motion of the latch. This face extends as far as the side flanks of the latch, which it borders with relatively sharp edges. In this way, dirt is kept from becoming trapped in the gap between the flanks of the latch and the side walls of the sawslot. The cleaning profile may be considered to be a tooth profile.

The cleaning profile is preferably provided on latch needles with freely pivotably supported latches. Such latch needles lack any means for fixation of the latch in selected positions, such as springs, slides or the like. Instead, the latch can pivot back and forth freely and with little friction on its bearing journal, and the pivoting motion is controlled by the yarn and/or the motion of the latch needle itself. The sawslot can be open on both sides, that is, continuously from the needle cheek to the needle back, or closed on the back side. In both cases, the cleaning profile of the latch keeps the sawslot clean.

The latch needle may, however, also be provided with a spring if needed, which resiliently supports one or more selected pivoting positions of the latch. In that case, the cleaning profile can be provided in addition to other function profiles that cooperate with the spring. The cleaning profile can keep the sawslot clean independently of them.

Further details of advantageous embodiments of the invention will become apparent from the claims, drawing or the description. In the drawing, exemplary embodiments of the invention are shown.

DETAILED DESCRIPTION OF THE INVENTION

Figure 1:
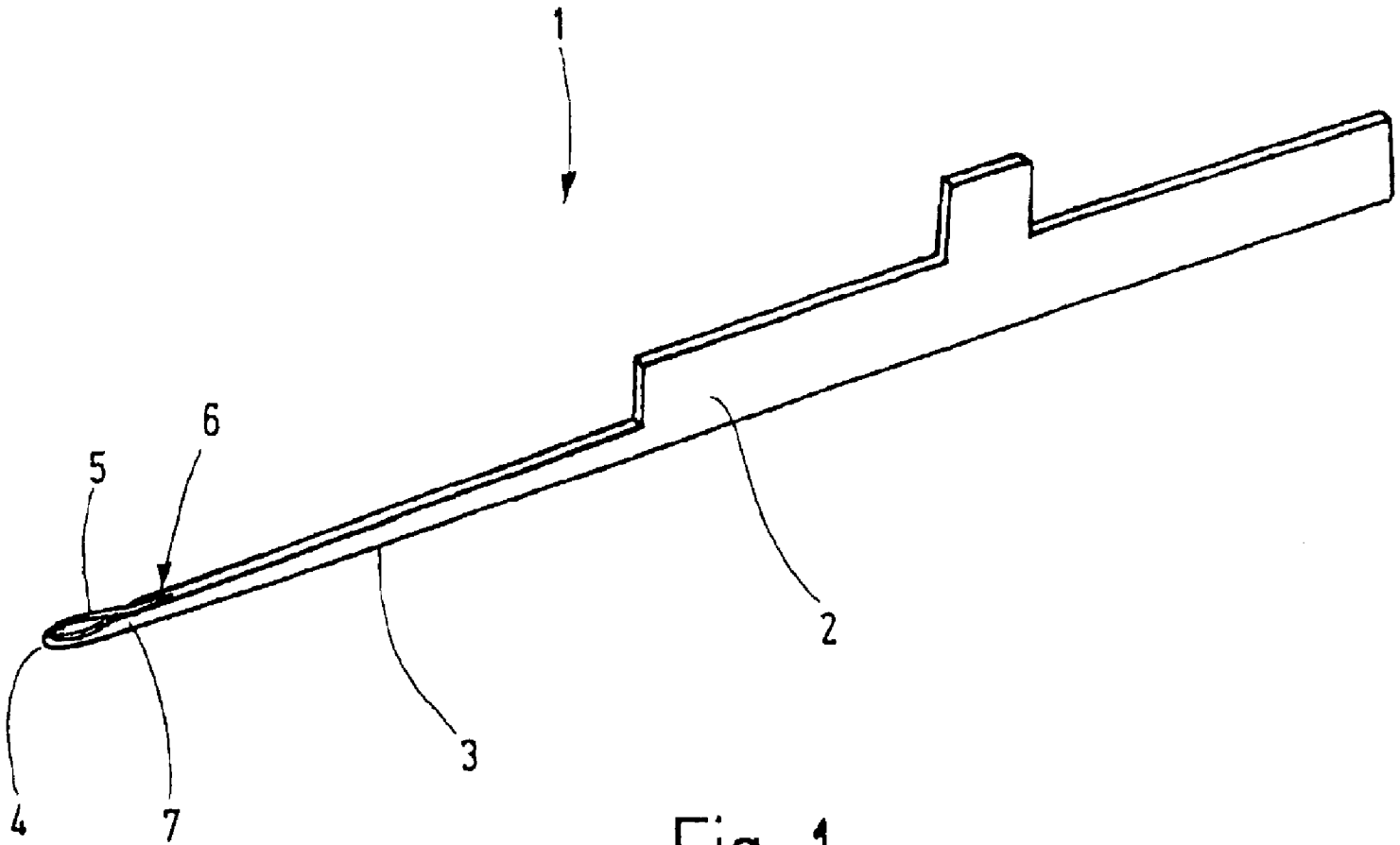
FIG. 1 is a simplified perspective view of a latch needle.
Figure 2:
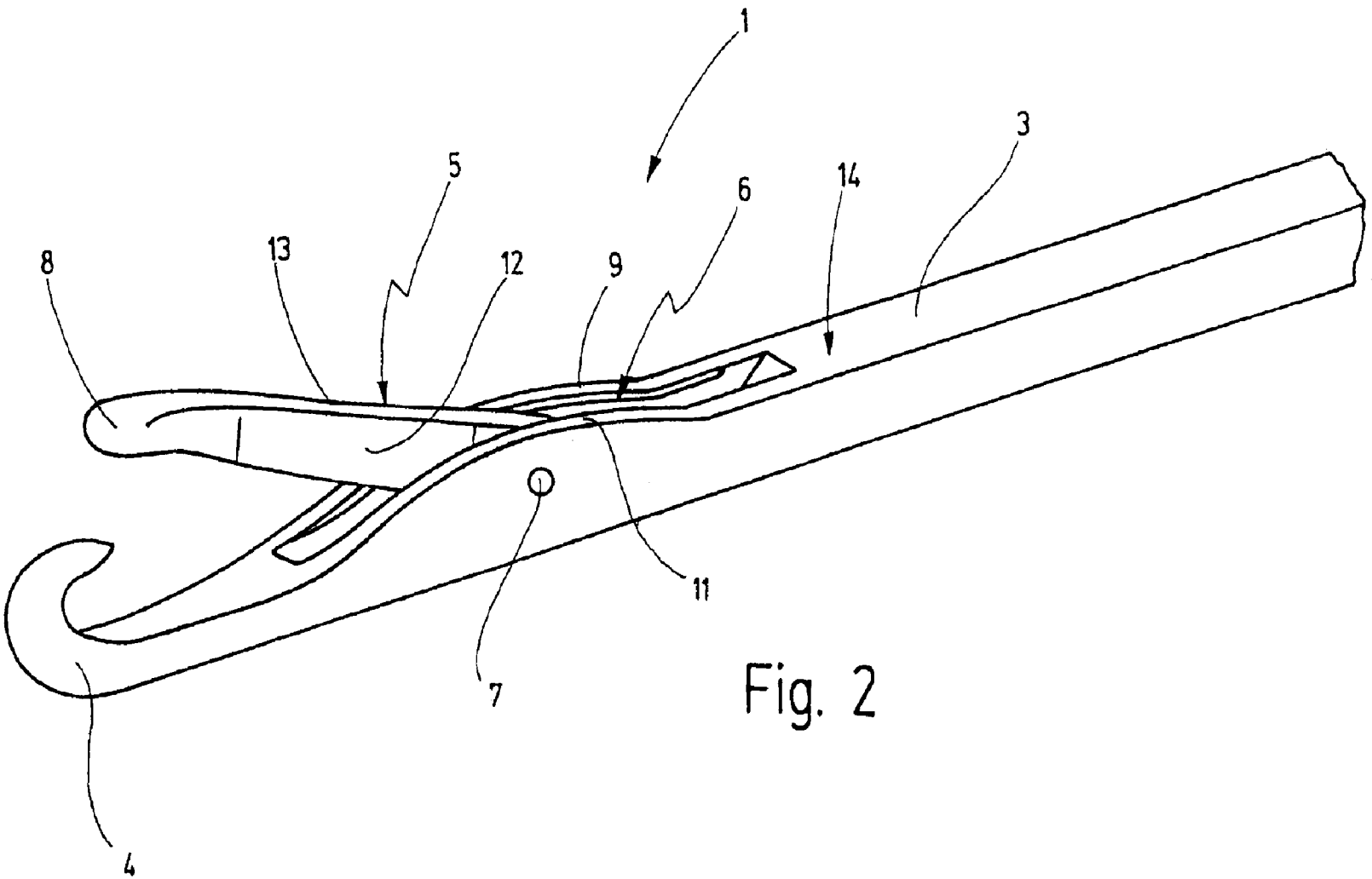
FIG. 2 is a detail, on a different scale, of the latch needle of FIG. 1.

In FIG. 1, a latch needle 1 is shown, which has a needle body 2 with a shank 3 that on its end is provided with a hook 4. Associated with the hook is a latch 5, which is pivotably supported in a sawslot 6 by means of a bearing device 7. As FIG. 2 shows, the sawslot 6 is disposed in the immediate vicinity of the hook 4, so that the latch 5, with its spoon 8, can on the one hand touch the hook 4 and thus close a yarn chamber and on the other can reach a supine position in contact with the shank 3.

Figure 3:
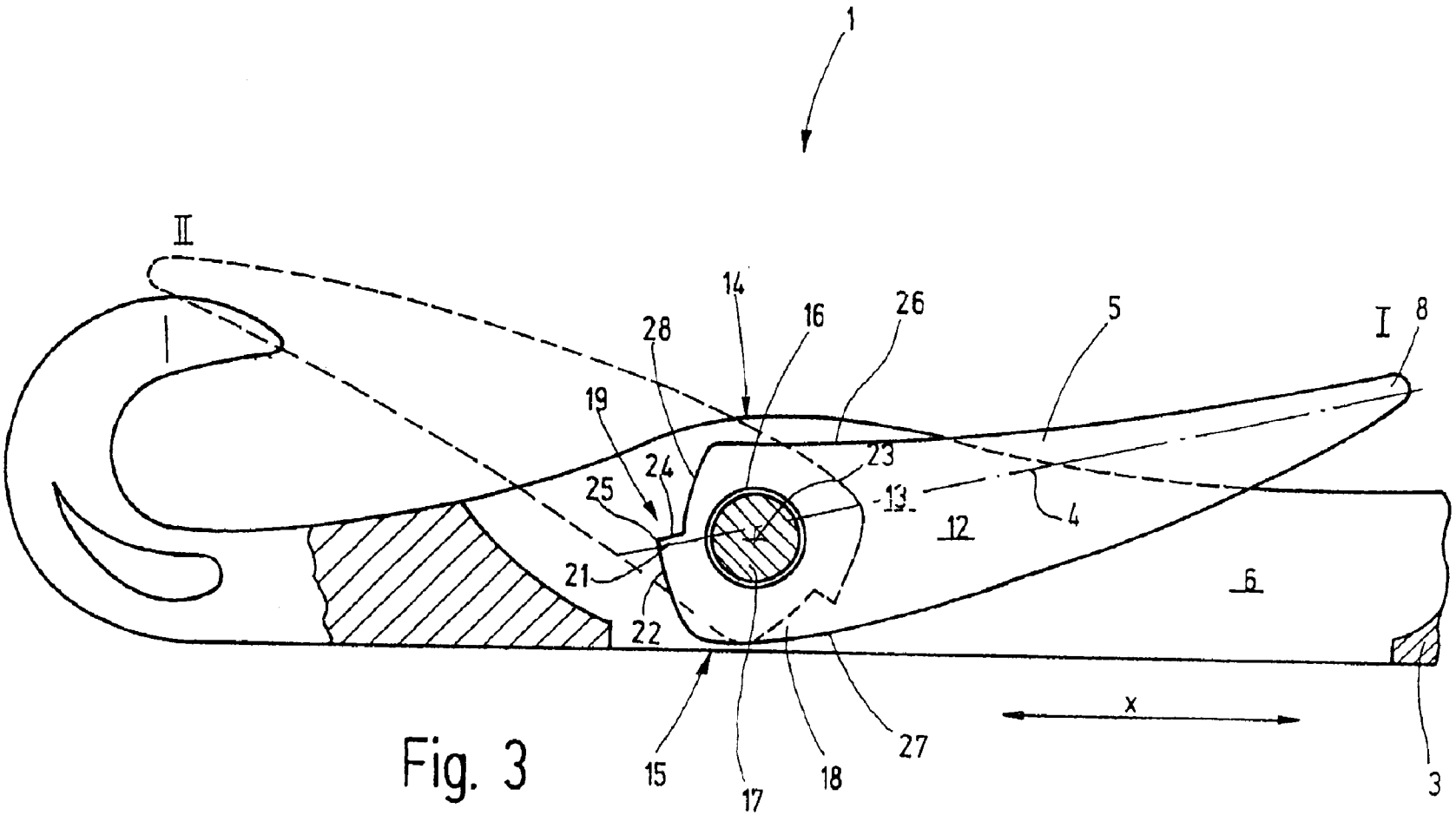
FIG. 3 is a side view, partly in section, on a different scale of the latch needle of FIG. 1 or FIG. 2, showing the features of the present invention.

The sawslot 6 is defined by two sawslot walls 9, 11, toward which the latch 5 orients its flanks 12,13. In the exemplary embodiment of FIG. 3, the sawslot 6 extends from the needle top 14 to the needle back 15; that is, it is embodied as open on both sides. As also shown in FIG. 3, the latch 5 has a bearing journal 17 reaching through it at a latch hole 16 and forming the bearing device 7. The bearing journal 17, in the exemplary embodiment of FIG. 3, is disposed approximately centrally between the needle top 14 and the needle back 15. The disposition of the bearing device 7 relative to the needle top 14 or to the needle back 15 should be defined as a function of the particular knitting application. The latch hole 16 may be disposed in the latch shank end 18 either centrally or eccentrically between the latch shank underside 26 and the back face 27.

The end of the latch 5 provided with the latch hole 16 is the latch shank end 18, which is provided with a cleaning profile 19. The cleaning profile is formed for instance by a shoulder 21, at which the rear end face 22 abruptly decreases its spacing from the center 23 of the latch hole 16. The result is a preferably radially extending, that is, circumferentially oriented, clearing face 24, which with somewhat sharp edges adjoins the flanks 12, 13 of the latch 5. Moreover, preferably with a somewhat sharp edge 25, the clearing face 24 adjoins the end face 22. In the embodiment of FIG. 3, the clearing face 24, with the latch 5 in the supine position, points toward the needle top 14. The shoulder 21 is preferably disposed on a line that includes the latch hole 16 and the spoon 8. The applicable line L is shown in dot-dashed lines in FIG. 3. Moreover, the maximum spacing of the end face 22 from the center 23 (measured for instance at the point predetermined by the line L) matches the greatest spacing of the latch shank underside 26 or the back face 27 of the latch 5 from the center 23. Conversely, adjoining the shoulder 24 is a region 28 of the latch 5 located closer to the center 23.

The latch needle 1 described thus far functions as follows:

In operation, the latch 5 is moved in reciprocation along its longitudinal direction X. In the process, the latch 5, supported with low friction and freely pivotably, periodically pivots out of the position I represented by solid lines in FIG. 1 into the position II shown in dashed lines, and back again. In the process, the clearing face 24 also pivots back and forth. As a result, every time the latch 5 pivots out of position II into position I, dirt that has reached the sawslot 6 is caught by the clearing face 24 and moved, or in other words carried along with it. This dirt is thus brought out of the sawslot 6 at both the needle back 15 and the needle top 14. In this way, the smooth running of the motion of the latch 5 is preserved. Because the clearing face 24 is embodied as essentially flat, dirt pushed ahead of the clearing face 24 is furthermore prevented from becoming caught in the gap between the flanks 12, 13 and the inner sides of the sawslot walls 9, 11.

Figure 4:
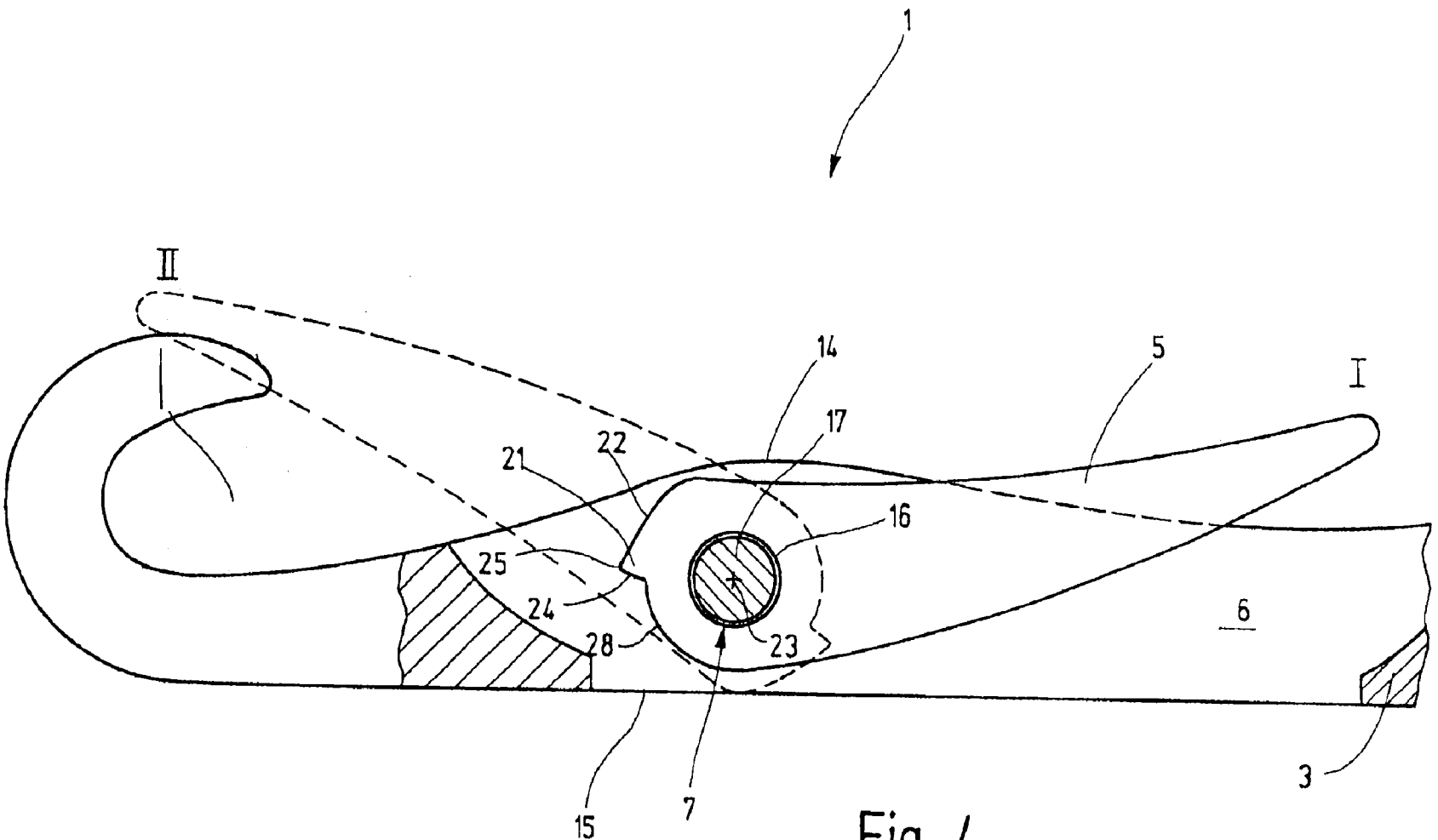
FIG. 4 is a side view, partly in section, of a modified embodiment of the latch needle of FIG. 3.

FIG. 4 shows a modified embodiment of the invention. Reference is made to the description above, based on the same reference numerals. The differences that exist are explained below:

The shoulder 21 is oriented contrary to the exemplary embodiment described above. If the latch 5 is in the supine position (position I) shown in FIG. 4, then the clearing face 24 points toward the needle back 15. Moreover, the rounding of the edge 25 is somewhat greater, and the clearing face 24 is not oriented precisely radially. The region 28 of the end face 22 approximately follows a radius, relative to the center 23 of the latch hole 16. This provision enhances the effectiveness of the clearing face 24 in carrying dirt away from the sawslot 6. Moreover, the advancement of the dirt is effected in each case in the reverse stroke of the needle, that is, at the transition of the latch 5 from position I into position II. The feeding of the dirt takes place here predominantly toward the needle back 15.

Figure 5:
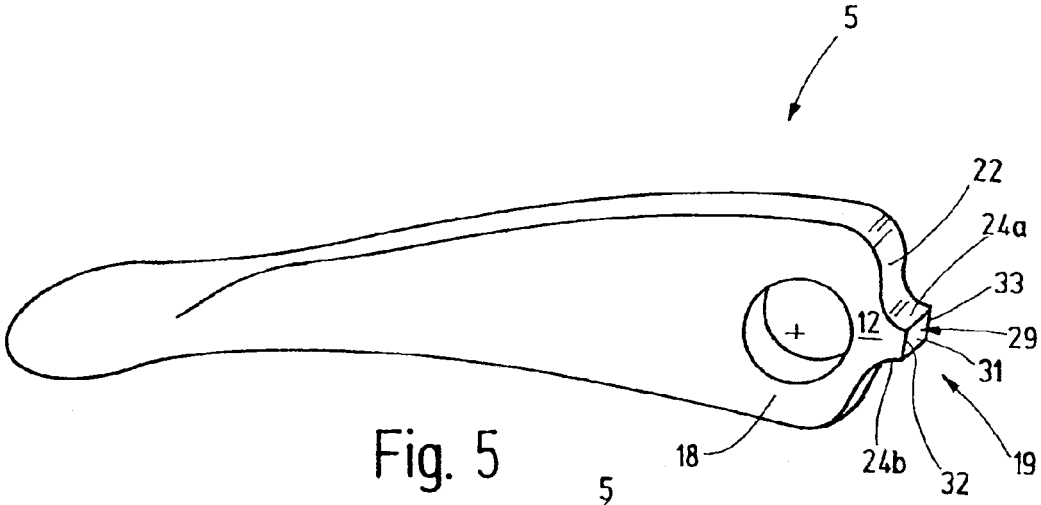
FIG. 5 is a perspective view of a further embodiment of a latch for a latch needle according to the invention.

FIG. 5 shows a further-modified embodiment of a latch 5, with a protrusion 29, provided on the end face 22, as its clearing face or cleaning profile 19. The protrusion 29 is provided with an essentially flat end face 31, which is defined all the way around by sharp edges. In particular, the end face 31 adjoins the flank 12 with a sharp edge 32 and adjoins the flank 13 with a sharp edge 33. Toward the essentially flat clearing faces 24*a* and 24*b*, the edges may be rounded or as needed also may be sharp.

The advantage of this latch 5 is in the clearing and cleaning action in both pivoting directions, that is, both at the transition from position I to position II and vice versa.

Figure 6:
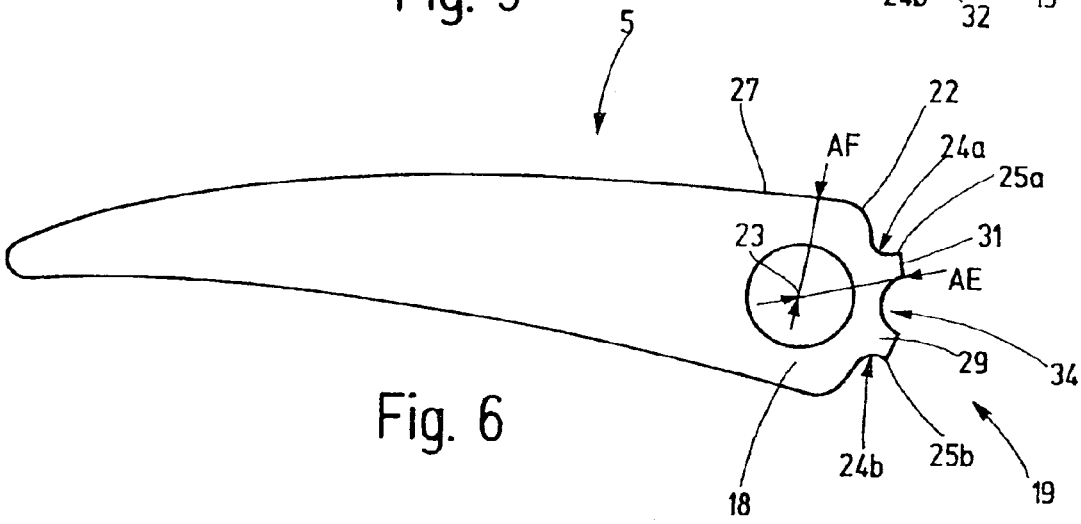
FIGS. 6 and 7 are side views of further embodiments of a latch according to the invention, with different cleaning profiles.

A further embodiment of the latch 5 is shown in FIG. 6. For this embodiment, the same remarks apply as for the embodiment of FIG. 5. Moreover, as in the examples already described above, it is true here as well that the spacing AF from the back face 27 to the center 23 is approximately equal to the spacing AE from the end face 22 to the center 23. The ratio of AF to AE (AF/AE) is in the range from 0.8 to 1.5 and is preferably 1. AE is measured at the portion of the end face 22 that is farthest away from the center 23, or in other words at the end face 31. This end face may, as FIG. 6 shows, be provided with a recess 34, which under some circumstances improves the effectiveness of cleaning still further.

Figure 7:
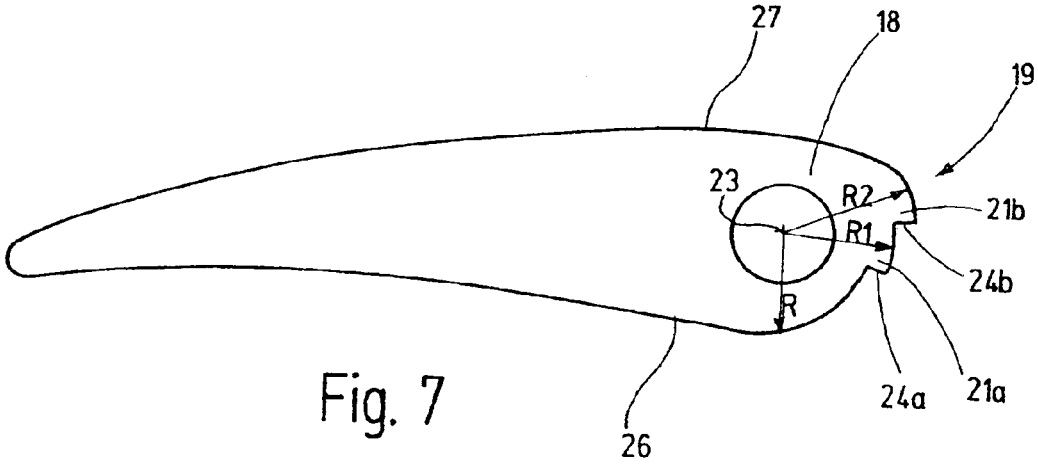

As FIG. 7 shows, instead of a single shoulder 21, a succession of shoulders 21*a*, 21*b* may be provided, oriented in either the same or different directions. In the simplest case, the latch shank underside 26, beginning at a first radius R in the region of the latch shank end 18, changes over at the shoulder 21*a* to a first, greater value R1 and at the shoulder 21*b* to a second, still-greater value R2. The clearing faces 24*a*, 24*b* that result are oriented preferably approximately radially. Beginning at the latch shank underside 26, the radius R increases. However, it is also possible to allow the shoulders to begin at the back face 27, in order to create the cleaning profile 19.

In all the cases named above, the shoulders 21 (21*a*, 21*b*) form teeth, which serve and are arranged to catch the dirt that has gotten into the sawslot 6 and convey it to the outside.

Figure 8:
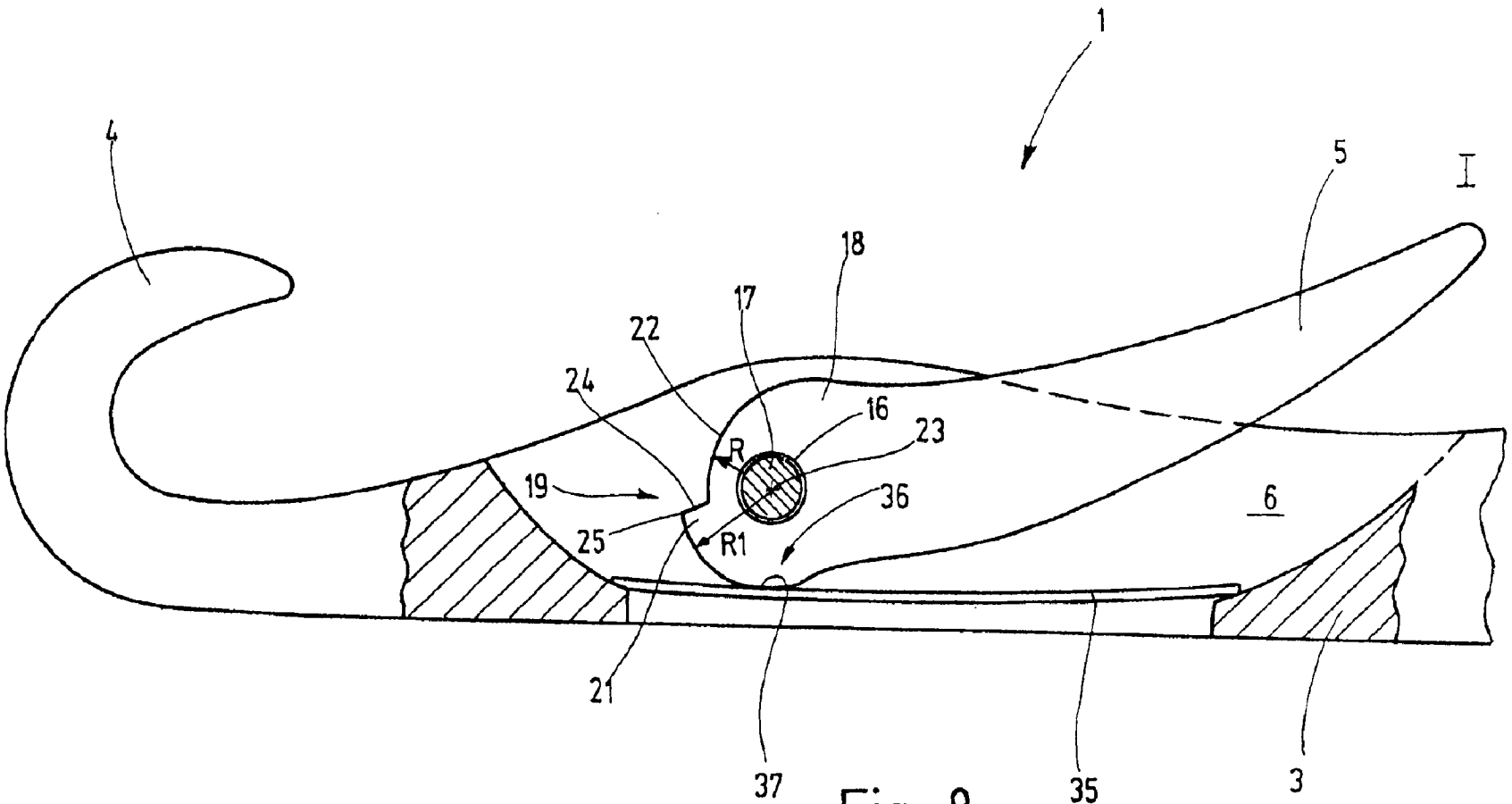
FIG. 8 is a side view, partly in section, of one embodiment of a latch needle of the invention with a latch spring.

FIG. 8 shows a further-modified embodiment of the latch needle 1, in which a latch spring 35 is disposed in the sawslot 6. This latch spring cooperates with a function profile 36 of the latch 5, which is embodied on the latch shank end 18 in addition to the cleaning profile 19. The function profile 36 can for instance be formed by a flattened face, that is, a plane face or facet 37, which rests flatly on the latch spring 35 just before the latch 5 assumes the fully supine position. In this way, the latch 5 can have a stable supine position, in which it does not rest entirely on the shank 3. To avoid spring damage, the edge 25 may be rounded somewhat. In this exemplary embodiment, the clearing face 24 as described above serves to clear and clean the sawslot. It is embodied at the shoulder 21 at which the end face 22 changes from a radius R1 to the radius R. Preferably, the radius R1 is somewhat less than the spacing of the facet 37 from the center 23.

Figure 9:
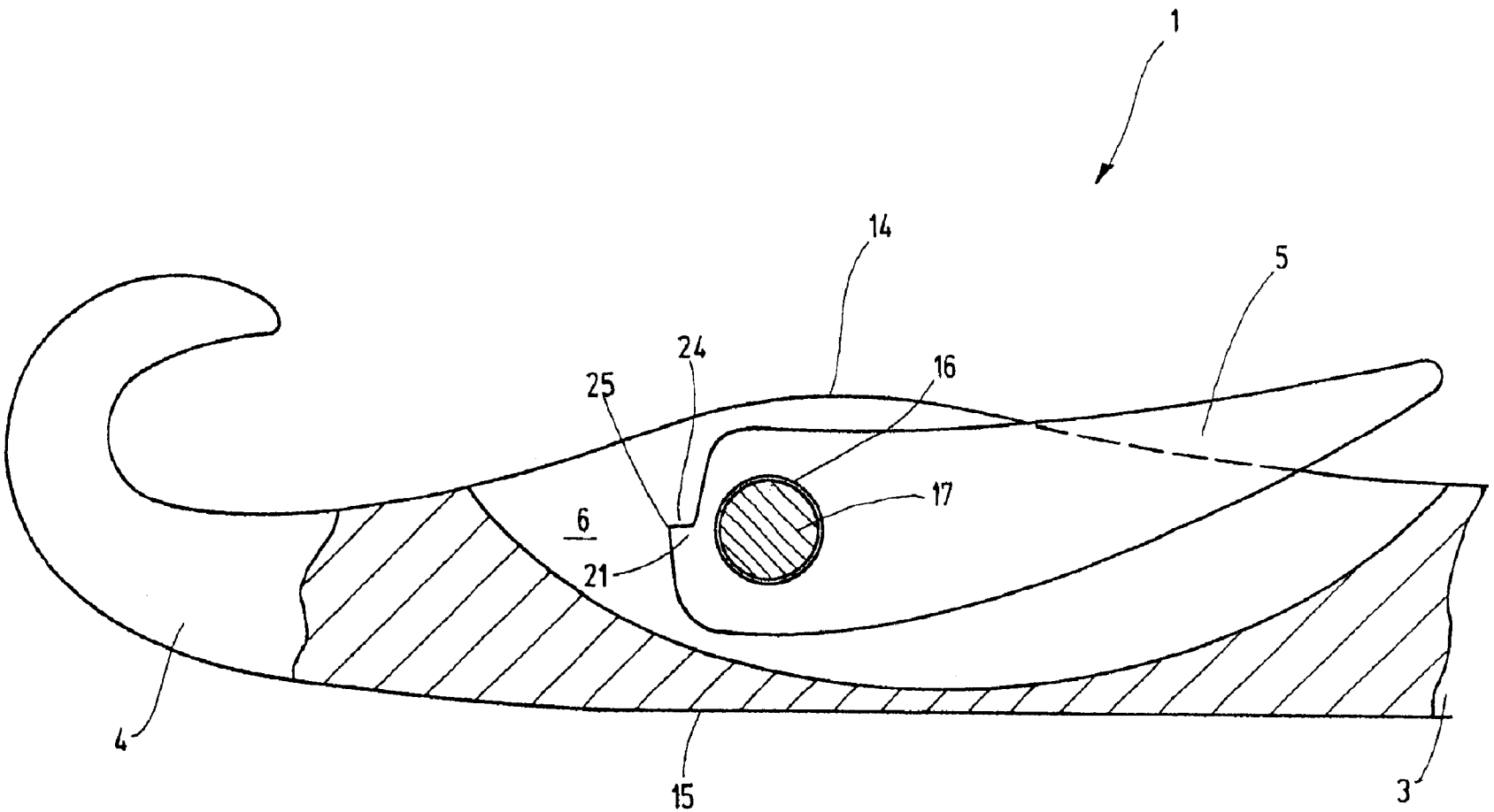
FIG. 9 is a side view, partly in section, of an embodiment of a latch needle with a sawslot that is closed at the back.

A further embodiment of the latch needle 1 of the invention is shown in FIG. 9. The difference from the latch needles described above is that the sawslot 6 is open only on the needle top 14 but is closed on the needle back 15. All the latches 5 described above may be used. In particular, an embodiment of the latch 5 in accordance with FIG. 3, 5, 7 or 9 is preferred. Particularly with respect to these figures, the above description applies accordingly.

A latch needle 1 is provided with a latch 5, which has a clearing profile 19 on its latch shank end 18. The clearing profile 19 serves to keep the sawslot 6 free of dirt. To that end, it has at least one special clearing face 24.

It will be appreciated that the above description of the present invention is susceptible to various modifications, changes and adaptations, and the same are intended to be comprehended within the meaning and range of equivalents of the appended claims.

List of Reference Numerals:

| | |
|---|---|
| 1 | Latch needle |
| 2 | Needle body |
| 3 | Shank |
| 4 | Hook |
| 5 | Latch |
| 6 | Sawslot |
| 7 | Bearing device |
| 8 | Spoon |
| 9, 11 | Sawslot walls |
| 12, 13 | Flanks |
| 14 | Needle top |
| 15 | Needle back |
| 16 | Latch hole |
| 17 | Bearing journal |
| 19 | Cleaning profile |
| 21, 21a, 21b | Shoulder |
| 22 | End face |
| 23 | Center |
| 24 | Clearing face |
| 25 | Edge |
| 26 | Latch shank underside |
| 27 | Back face |
| 28 | Region |
| 29 | Protrusion |
| 31 | End face |
| 32, 33 | Edges |
| 35 | Latch spring |
| 36 | Function profile |
| 37 | Facet |
| AE | Spacing |
| AF | Spacing |
| L | Line |
| R | Radius |
| X | Longitudinal direction |
| I, II | Positions |

What is claimed is:

1. A latch needle for knitting machines comprising:

a needle body, which has a shank that on its end is provided with a hook and that near the hook is provided with a sawslot; and, a latch, which is disposed, pivotably supported, in the sawslot on a latch bearing device and is provided there with a cleaning profile including at least one sharp cutting edge.

2. The latch needle of claim 1, wherein the latch is supported freely pivotably, without hindrance, by the latch bearing device.

3. The latch needle of claim 1, wherein the sawslot extends from a needle top to a needle back and is open on both the needle top and the needle back.

4. The latch needle of claim 1, wherein the cleaning profile is formed by a tooth profile on one end face of the latch.

5. The latch needle of claim 1, wherein in every pivoting position, the latch is guided exclusively by a bearing journal and by walls of the sawslot.

6. The latch needle of claim 4, wherein at least one shoulder embodied on the end face is part of the cleaning profile.

7. The latch needle of claim 4, wherein the cleaning profile has at least one clearing face, which extends essentially in the radial direction with respect to the bearing device.

8. The latch needle of claim 6, wherein the shoulder is disposed at a point of the latch that is opposite the latch spoon.

9. The latch needle of claim 1, wherein a latch spring which cooperates with the latch is disposed in the sawslot.

10. The latch needle of claim 9, wherein: the sharp cutting edge extends parallel to a pivot axis of the bearing device: and, the end surface of the latch within the sawslot is additionally provided with a function profile to cooperate with the spring, with the function profile being separate from the cleaning profile and having a radius from the bearing device such that the sharp cutting edge of the cleaning profile does not engage the spring.

11. The latch needle of claim 1, wherein the at least one sharp cutting edge extends parallel to a pivot axis of the bearing device.

12. The latch needle of claim 11, wherein the at least on sharp cutting edge extends across an entire width of the latch substantially to opposite side walls of the sawslot.

13. The latch needle of claim 7, wherein: the at least one sharp cutting edge extends parallel to a pivot axis of the bearing device; the tooth profile is formed by an abrupt change between a larger and a smaller radius of the end surface of the latch to define the substantially flat clearing face extending essentially in a radial direction relative to a pivot axis of the bearing device, and with the at east one sharp cutting edge being located at the larger radius end of the clearing face.

14. The latch needle of claim 1, wherein the cleaning profile comprises a radially extending projection on an outer surface of the latch within the sawslot, with the projection having a substantially flat rectangular outer surface, wit a first pair of opposed edges of the rectangular surface extending parallel to a pivot axis of the bearing device and with a second pair of opposed edges of the rectangular surface extending transverse to said first pair of opposed edges; and, at least one of said first pair of opposed edges constitutes a respective said sharp cutting edge.

15. The latch needle of claim 14, wherein each of said second pair of opposed edges likewise constitutes a sharp cutting edge.

16. The latch needle of claim 7, wherein said clearing face and a latch spoon are disposed on opposite ends of the latch along a substantially straight line passing substantially through a pivot axis of the bearing device.

17. A latch needle for knitting machines comprising:

a needle body having a shank that is provided at one end with a hook and a sawslot near the hook; and, a latch having one end disposed in the sawslot and mounted on latch bearing device for pivotal movement about a pivot axis and with said one end being provided with a cleaning profile on an end face of the latch, which cleaning profile includes at least one tooth profile formed on said one end face of the latch and defining at least one clearing face that extends essentially in a radial direction with respect to the pivot axis of the bearing device at a point where the radial distance from the pivot axis to the end face of the latch abruptly changes between a larger an a smaller radial distance and forms a sharp edge extending essentially parallel the pivot axis at the larger radial distance.

18. The latch needle of claim 17, wherein the latch extends to and is guided by opposed side walls of the sawslot, and the sharp edge extends to each of the side walls.

19. The latch needle of claim 17, wherein said clearing face and a latch spoon are disposed at opposite ends of the latch along a substantially straight line passing substantially through the pivot axis of the bearing device.

* * * * *